US011656012B2

(12) United States Patent
Zha

(10) Patent No.: US 11,656,012 B2
(45) **Date of Patent: *May 23, 2023**

(54) COOLING SYSTEM WITH VERTICAL ALIGNMENT

(71) Applicant: Heatcraft Refrigeration Products LLC, Stone Mountain, GA (US)

(72) Inventor: Shitong Zha, Snellville, GA (US)

(73) Assignee: Heatcraft Refrigeration Products LLC, Stone Mountain, GA (US)

( * ) Notice: Subject to any disclaimer, the term of this patent is extended or adjusted under 35 U.S.C. 154(b) by 40 days.

This patent is subject to a terminal disclaimer.

(21) Appl. No.: 17/471,517

(22) Filed: Sep. 10, 2021

(65) Prior Publication Data

US 2021/0404717 A1 Dec. 30, 2021

Related U.S. Application Data

(63) Continuation of application No. 16/782,618, filed on Feb. 5, 2020, now Pat. No. 11,149,997.

(51) Int. Cl.

| | |
|---|---|
| ***F25B 41/40*** | (2021.01) |
| ***F25B 41/20*** | (2021.01) |
| ***F25B 1/00*** | (2006.01) |
| ***F25B 49/02*** | (2006.01) |

(52) U.S. Cl.

CPC ..... *F25B 41/40* (2021.01); *F25B 1/00* (2013.01); *F25B 41/20* (2021.01); *F25B 49/02* (2013.01); *F25B 2600/2515* (2013.01); *F25B 2700/1931* (2013.01)

(58) Field of Classification Search

CPC .. F25B 41/40; F25B 1/00; F25B 41/20; F25B 49/02; F25B 2600/2551; F25B 2700/1931; F25B 41/24; F25B 9/008; F25B 2400/13; F25B 2400/23; F25B 2500/01;

(Continued)

(56) References Cited

U.S. PATENT DOCUMENTS 4,081,134 A 3/1978 Anderson
4,625,523 A * 12/1986 Toub ..... F25B 31/004 62/193
5,875,640 A 3/1999 Hill (Continued)

OTHER PUBLICATIONS

European Patent Office, Extended Search Report, Application No. 21154928.2, dated Jun. 7, 2021, 6 pages.

(Continued)

*Primary Examiner* — Kun Kai Ma
(74) *Attorney, Agent, or Firm* — Baker Botts L.L.P.

(57) ABSTRACT

A cooling system uses P-traps to address the oil return issues that result from a vertical separation between the compressor and the high side heat exchanger. Generally, the vertical piping that carries the refrigerant from the compressor to the high side heat exchanger includes P-traps installed at various heights to capture oil in the refrigerant and to prevent that oil from flowing back to the compressor. As oil collects in the P-traps, the refrigerant begins to push the oil upwards until the oil reaches the high side heat exchanger. Multiple piping of different sizes may be used depending on a discharge pressure of the compressor. When the discharge pressure is higher, a larger piping may be used direct the oil and refrigerant to the high side heat exchanger.

20 Claims, 6 Drawing Sheets

(58) Field of Classification Search
CPC ..... F25B 2500/16; F25B 2600/2519; F25B 2700/03; F25B 5/02; F25B 31/004; F25B 1/10
See application file for complete search history.

(56) References Cited

U.S. PATENT DOCUMENTS

| | | | | |
|---|---|---|---|---|
| 9,625,183 | B2 | 4/2017 | Wallace et al. | |
| 9,964,348 | B2 | 5/2018 | Ali et al. | |
| 9,982,919 | B2 | 5/2018 | Ali et al. | |
| 10,208,985 | B2 | 2/2019 | Najafifard | |
| 10,551,081 | B1 | 2/2020 | Miller-Russell | |
| 2007/0023163 | A1 | 2/2007 | Kidwell et al. | |
| 2009/0093916 | A1* | 4/2009 | Parsonnet ..... | F24F 5/0017 700/286 |
| 2010/0251756 | A1 | 10/2010 | Scarcella et al. | |
| 2010/0326100 | A1 | 12/2010 | Taras et al. | |
| 2011/0023514 | A1 | 2/2011 | Mitra et al. | |
| 2012/0011866 | A1 | 1/2012 | Scarcella et al. | |
| 2012/0192579 | A1 | 8/2012 | Huff et al. | |
| 2012/0227427 | A1 | 9/2012 | Liu et al. | |
| 2012/0285185 | A1 | 11/2012 | Huff | |
| 2012/0318006 | A1 | 12/2012 | Liu et al. | |
| 2012/0318008 | A1 | 12/2012 | Liu et al. | |
| 2013/0031934 | A1 | 2/2013 | Huff et al. | |
| 2013/0251505 | A1 | 9/2013 | Wang et al. | |
| 2013/0312376 | A1 | 11/2013 | Huff et al. | |
| 2014/0157821 | A1 | 6/2014 | Schrader et al. | |
| 2014/0326018 | A1 | 11/2014 | Ignatiev | |
| 2015/0204589 | A1 | 7/2015 | Liu | |
| 2015/0219379 | A1 | 8/2015 | Sun et al. | |
| 2015/0233624 | A1 | 8/2015 | Hellmann et al. | |
| 2015/0300713 | A1 | 10/2015 | Sun et al. | |
| 2015/0345835 | A1 | 12/2015 | Martin et al. | |
| 2016/0272047 | A1 | 9/2016 | Gan | |
| 2017/0138643 | A1 | 5/2017 | Ignatiev et al. | |
| 2018/0187927 | A1 | 7/2018 | Zha | |
| 2018/0187928 | A1 | 7/2018 | Zha | |
| 2018/0195773 | A1* | 7/2018 | Saunders ..... | F25B 41/20 |
| 2018/0216851 | A1 | 8/2018 | Christensen et al. | |
| 2018/0274823 | A1 | 9/2018 | Rajendiran et al. | |
| 2018/0274835 | A1* | 9/2018 | Goel ..... | F25B 31/00 |
| 2018/0328628 | A1 | 11/2018 | Sun et al. | |
| 2019/0041102 | A1 | 2/2019 | Zha et al. | |
| 2019/0072299 | A1 | 3/2019 | Najafifard et al. | |
| 2019/0218029 | A1 | 7/2019 | Petz et al. | |
| 2021/0239373 | A1 | 8/2021 | Martin et al. | |
| 2021/0239374 | A1 | 8/2021 | Zha | |

OTHER PUBLICATIONS

Anonymous, "Refrigeration Troubleshooting Diagram," Oil Traps, http://www.refrigeratordiagrams.com/tag/oil-traps, retrieved May 25, 2021, 3 pages.

* cited by examiner

COOLING SYSTEM WITH VERTICAL ALIGNMENT

CROSS-REFERENCE TO RELATED APPLICATIONS

This application is a continuation of U.S. patent application Ser. No. 16/782,618 filed Feb. 5, 2020, by Shitong Zha, and entitled "COOLING SYSTEM WITH VERTICAL ALIGNMENT," which is incorporated herein by reference.

TECHNICAL FIELD

This disclosure relates generally to a cooling system.

BACKGROUND

Cooling systems may cycle a refrigerant (e.g., carbon dioxide refrigerant) to cool various spaces.

SUMMARY

Cooling systems may cycle a refrigerant (e.g., carbon dioxide refrigerant) to cool various spaces. These systems typically include a compressor to compress refrigerant and a high side heat exchanger that removes heat from the compressed refrigerant. When the compressor compresses the refrigerant, oil that coats certain components of the compressor may mix with and be discharged with the refrigerant.

When these systems are installed in tall buildings (e.g., high-rises), the high side heat exchanger may be installed on the roof of the building while the compressor is installed on a lower floor of the building. As a result, a significant vertical separation may exist between the compressor and the high side heat exchanger. If refrigerant from the compressor were directed to the high side heat exchanger, the oil that mixed with the refrigerant discharged by the compressor may not be able to overcome the vertical separation and, as a result, the oil may flow backwards to the compressor. To avoid this oil return issue, conventional systems use a separate water cooling system that cycles water that absorbs heat from the refrigerant discharged by the compressor. The water is then pumped to the high side heat exchanger on the roof so that the absorbed heat can be removed. The cooled refrigerant is cycled back to the rest of the cooling system, bypassing the high side heat exchanger. The water cooling system, however, increases the overall energy consumption, size, and cost of the cooling system.

This disclosure contemplates an unconventional cooling system that uses P-traps to address the oil return issues that result from a vertical separation between the compressor and the high side heat exchanger. Generally, the vertical piping that carries the refrigerant from the compressor to the high side heat exchanger includes P-traps installed at various heights to capture oil in the refrigerant and to prevent that oil from flowing back to the compressor. As oil collects in the P-traps, the refrigerant begins to push the oil upwards until the oil reaches the high side heat exchanger. Multiple piping of different sizes may be used depending on a discharge pressure of the compressor. When the discharge pressure is higher, a larger piping may be used direct the oil and refrigerant to the high side heat exchanger. Certain embodiments of the cooling system are described below.

According to an embodiment, a system includes a high side heat exchanger, a flash tank, a first low side heat exchanger, a second low side heat exchanger, a first compressor, a second compressor, first piping, second piping, a first valve, and a second valve. The high side heat exchanger removes heat from a refrigerant. The flash tank stores the refrigerant. The first low side heat exchanger uses the refrigerant to cool a space proximate the first low side heat exchanger. The second low side heat exchanger uses the refrigerant to cool a space proximate the second low side heat exchanger. The first compressor compresses refrigerant from the first low side heat exchanger. The second compressor compresses refrigerant from the second low side heat exchanger and the first compressor. The high side heat exchanger is positioned vertically above the second compressor. The first piping directs refrigerant from the second compressor to the high side heat exchanger. The first piping includes a first p-trap positioned vertically above the second compressor and vertically below the high side heat exchanger and a second p-trap positioned vertically above the first p-trap and vertically below the high side heat exchanger. The second piping directs refrigerant from the second compressor to the high side heat exchanger. The second piping is larger than the first piping. The second piping includes a third p-trap positioned vertically above the second compressor and vertically below the high side heat exchanger and a fourth p-trap positioned vertically above the first p-trap and vertically below the high side heat exchanger. The first valve controls a flow of refrigerant and oil from the second compressor to the first piping. The second valve controls a flow of refrigerant and oil from the second compressor to the second piping.

According to another embodiment, a method includes removing, by a high side heat exchanger, heat from a refrigerant and storing, by a flash tank, the refrigerant. The method also includes using, by a first low side heat exchanger, the refrigerant to cool a space proximate the first low side heat exchanger and using, by a second low side heat exchanger, the refrigerant to cool a space proximate the second low side heat exchanger. The method further includes compressing, by a first compressor, refrigerant from the first low side heat exchanger and compressing, by a second compressor, refrigerant from the second low side heat exchanger and the first compressor. The high side heat exchanger is positioned vertically above the second compressor. The method also includes directing, by first piping, refrigerant from the second compressor to the high side heat exchanger. The first piping includes a first p-trap positioned vertically above the second compressor and vertically below the high side heat exchanger and a second p-trap positioned vertically above the first p-trap and vertically below the high side heat exchanger. The method further includes directing, by second piping, refrigerant from the second compressor to the high side heat exchanger. The second piping is larger than the first piping. The second piping includes a third p-trap positioned vertically above the second compressor and vertically below the high side heat exchanger and a fourth p-trap positioned vertically above the first p-trap and vertically below the high side heat exchanger. The method also includes controlling, by a first valve, a flow of refrigerant and oil from the second compressor to the first piping and controlling, by a second valve, a flow of refrigerant and oil from the second compressor to the second piping.

According to yet another embodiment, a system includes a high side heat exchanger, a flash tank, a first low side heat exchanger, a second low side heat exchanger, a first compressor, a second compressor, first piping, second piping, and a valve. The high side heat exchanger removes heat from a refrigerant. The flash tank stores the refrigerant. The first low side heat exchanger uses the refrigerant to cool a space proximate the first low side heat exchanger. The second low side heat exchanger uses the refrigerant to cool a space proximate the second low side heat exchanger. The first compressor compresses refrigerant from the first low side heat exchanger. The second compressor compresses refrigerant from the second low side heat exchanger and the first compressor. The high side heat exchanger is positioned vertically above the second compressor. The first piping directs refrigerant from the second compressor to the high side heat exchanger. The first piping includes a first p-trap positioned vertically above the second compressor and vertically below the high side heat exchanger and a second p-trap positioned vertically above the first p-trap and vertically below the high side heat exchanger. The second piping directs refrigerant from the second compressor to the high side heat exchanger. The second piping is larger than the first piping. The second piping includes a third p-trap positioned vertically above the second compressor and vertically below the high side heat exchanger and a fourth p-trap positioned vertically above the first p-trap and vertically below the high side heat exchanger. The valve controls a flow of refrigerant and oil from the second compressor to the second piping.

Certain embodiments provide one or more technical advantages. For example, an embodiment uses P-traps to prevent oil from flowing back to a compressor when there is a vertical separation between the compressor and a high side heat exchanger. As another example, an embodiment reduces energy consumption, size, and cost relative to a cooling system that uses a separate water cooling system to overcome a vertical separation between a compressor and a high side heat exchanger. Certain embodiments may include none, some, or all of the above technical advantages. One or more other technical advantages may be readily apparent to one skilled in the art from the figures, descriptions, and claims included herein.

BRIEF DESCRIPTION OF THE DRAWINGS

For a more complete understanding of the present disclosure, reference is now made to the following description, taken in conjunction with the accompanying drawings, in which.

DETAILED DESCRIPTION

Embodiments of the present disclosure and its advantages are best understood by referring to FIGS. 1A through 3 of the drawings, like numerals being used for like and corresponding parts of the various drawings.

Cooling systems may cycle a refrigerant (e.g., carbon dioxide refrigerant) to cool various spaces. These systems typically include a compressor to compress refrigerant and a high side heat exchanger that removes heat from the compressed refrigerant. When the compressor compresses the refrigerant, oil that coats certain components of the compressor may mix with and be discharged with the refrigerant.

When these systems are installed in tall buildings (e.g., high-rises), the high side heat exchanger may be installed on the roof of the building while the compressor is installed on a lower floor of the building. As a result, a significant vertical separation may exist between the compressor and the high side heat exchanger. If refrigerant from the compressor were directed to the high side heat exchanger, the oil that mixed with the refrigerant discharged by the compressor may not be able to overcome the vertical separation and, as a result, the oil may flow backwards to the compressor. To avoid this oil return issue, conventional systems use a separate water cooling system that cycles water that absorbs heat from the refrigerant discharged by the compressor. The water is then pumped to the high side heat exchanger on the roof so that the absorbed heat can be removed. The cooled refrigerant is cycled back to the rest of the cooling system, bypassing the high side heat exchanger. The water cooling system, however, increases the overall energy consumption, size, and cost of the cooling system.

Figure 1A:
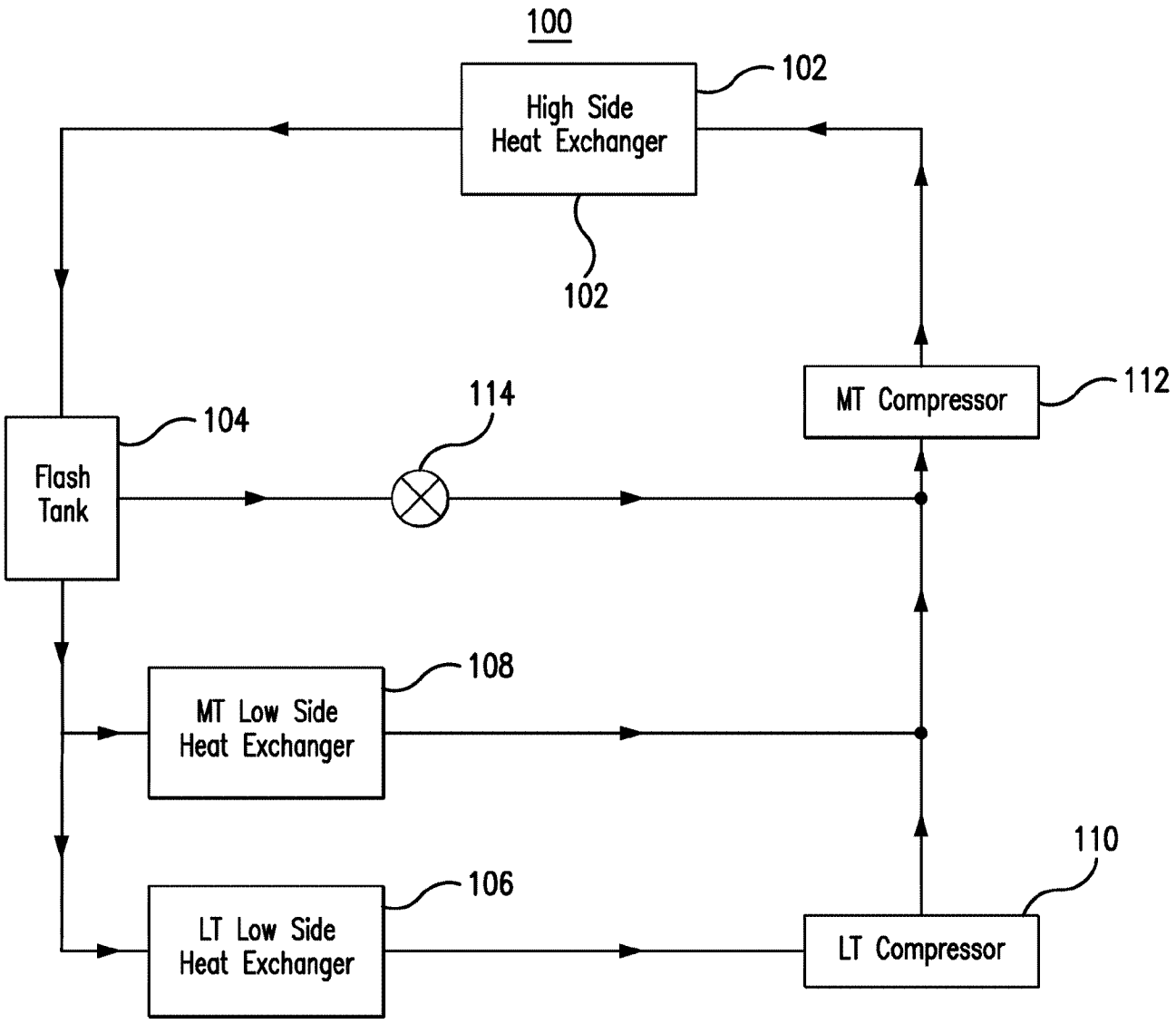
FIGS. 1A-1B illustrate an example cooling system.
Figure 1B:
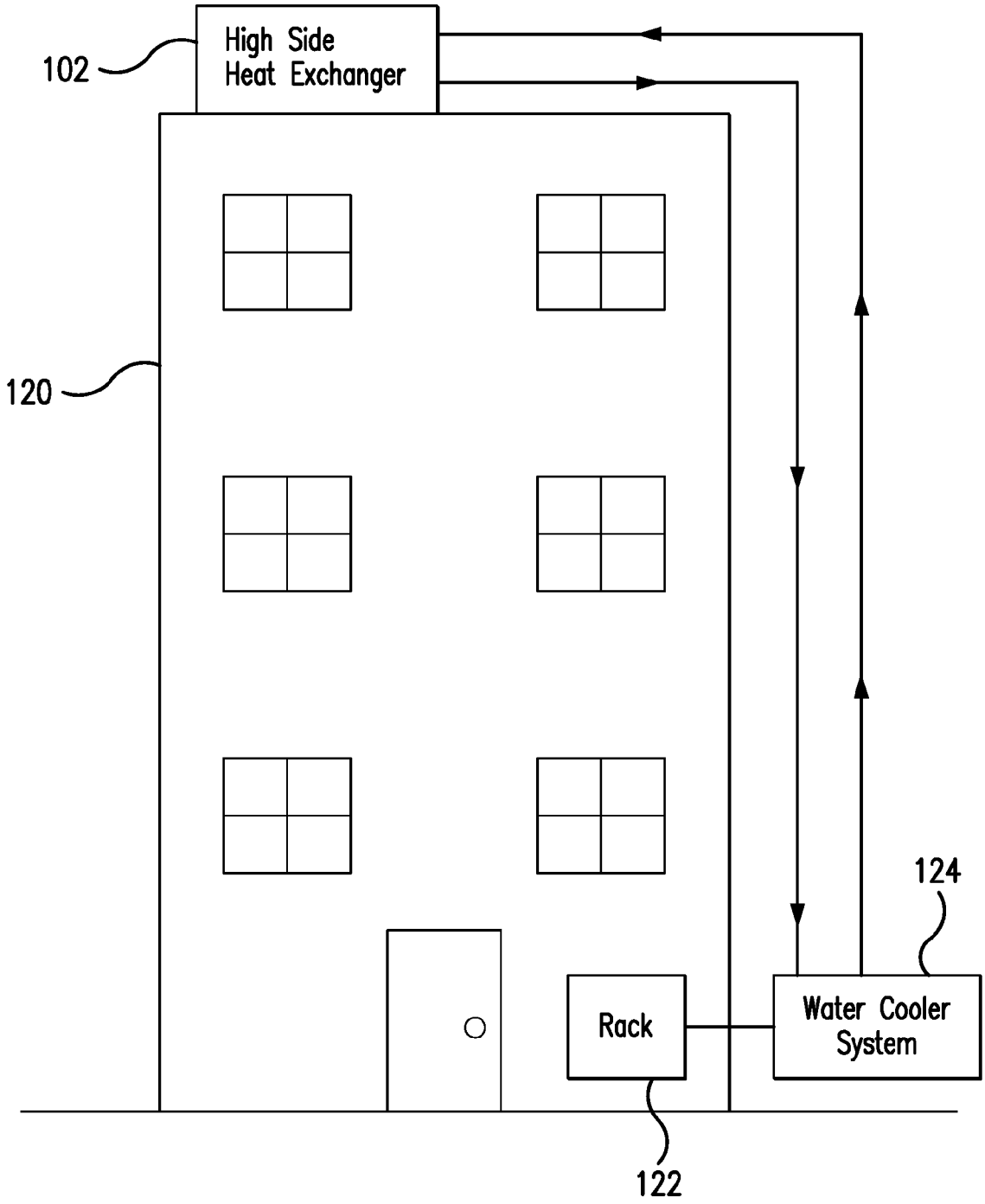
Figure 2A:
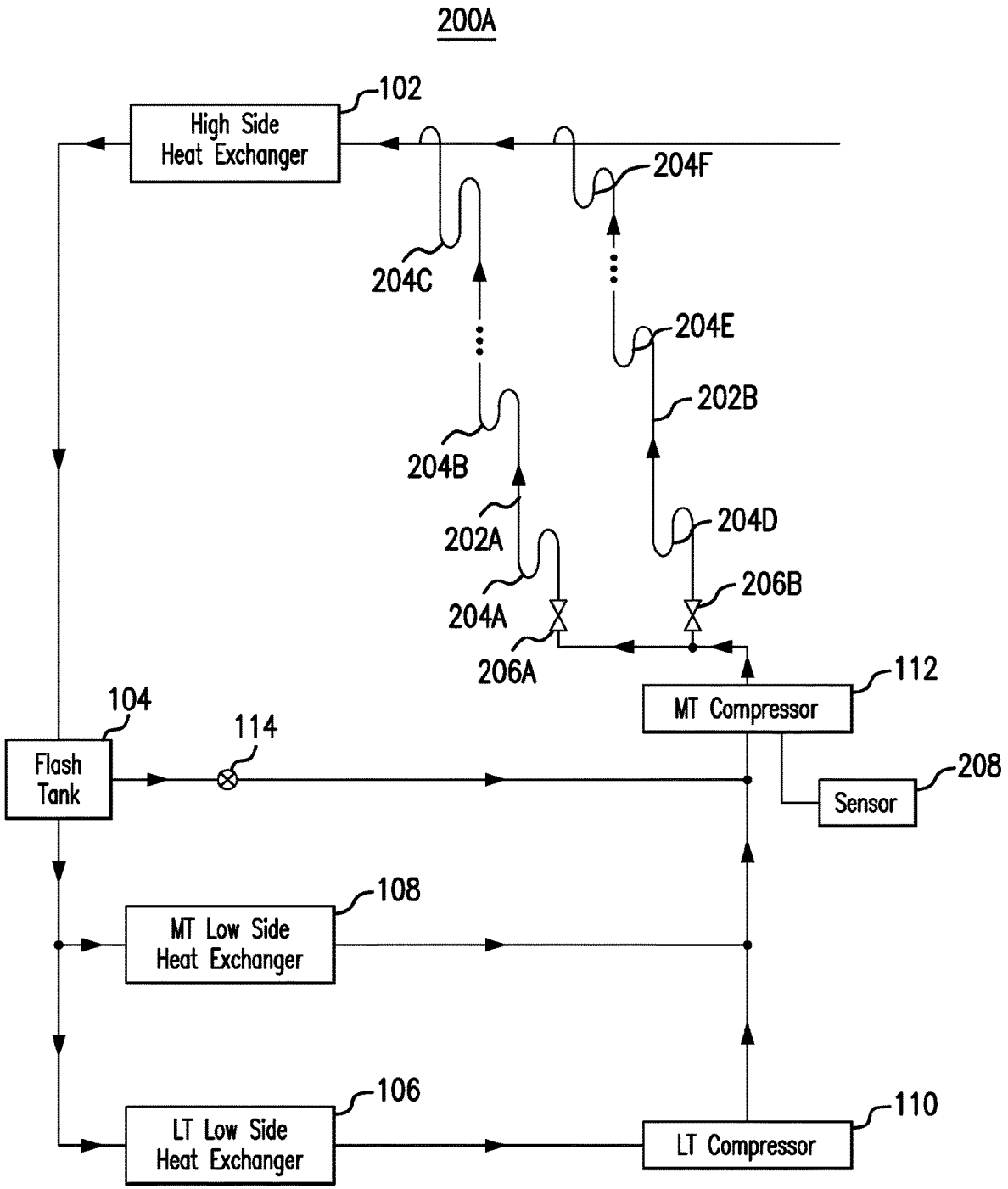
FIGS. 2A-2B illustrate example cooling systems.
Figure 2B:
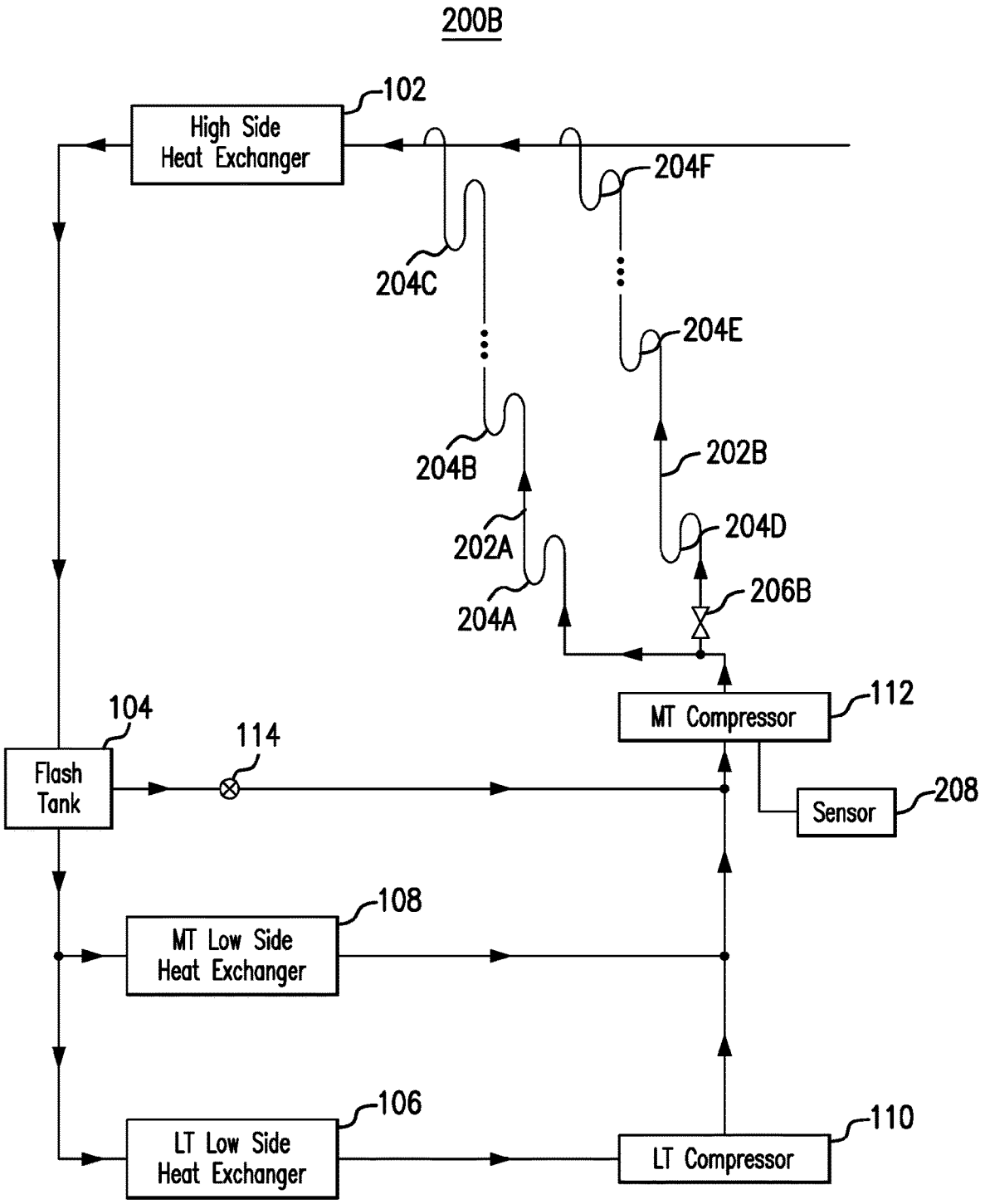
Figure 3:
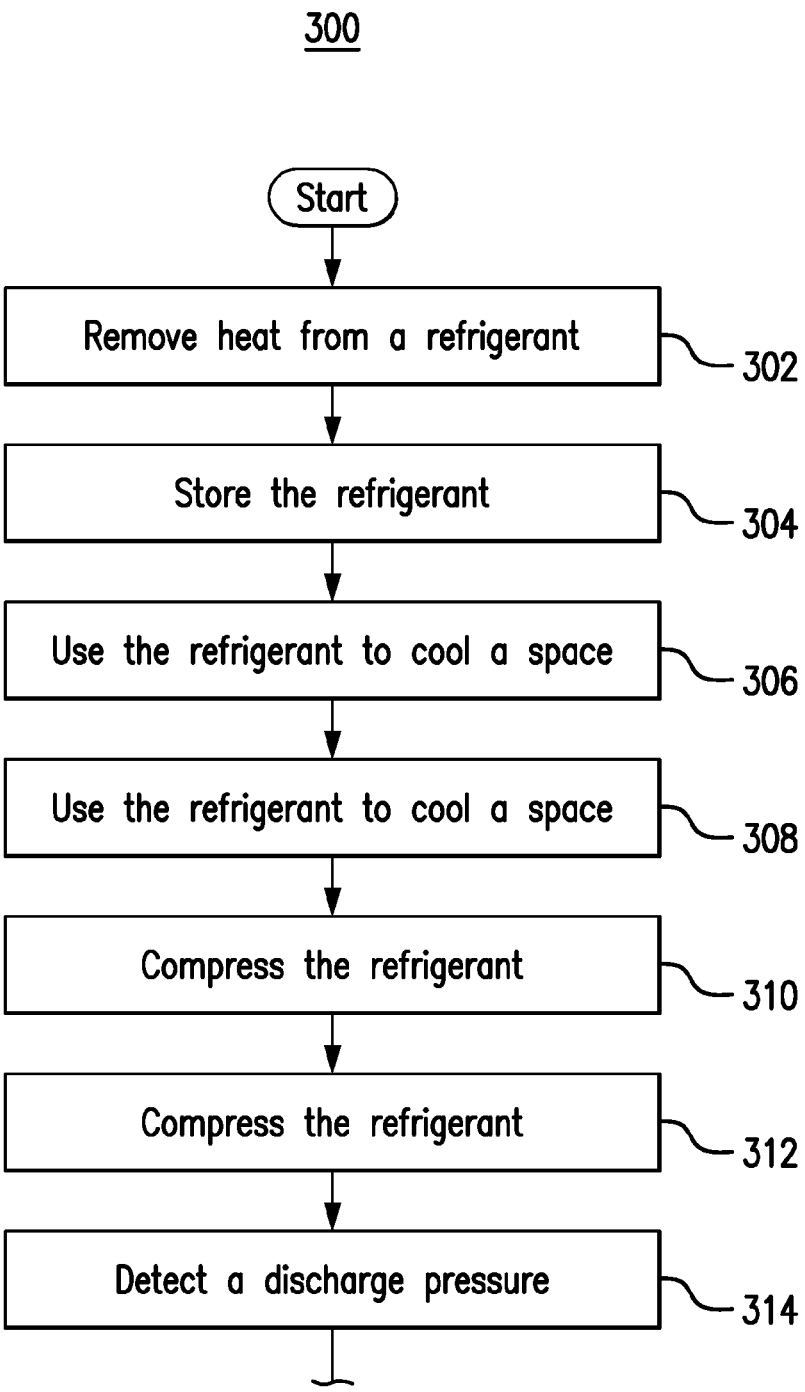
FIG. 3 is a flowchart illustrating a method of operating an example cooling system.
Figure 3:
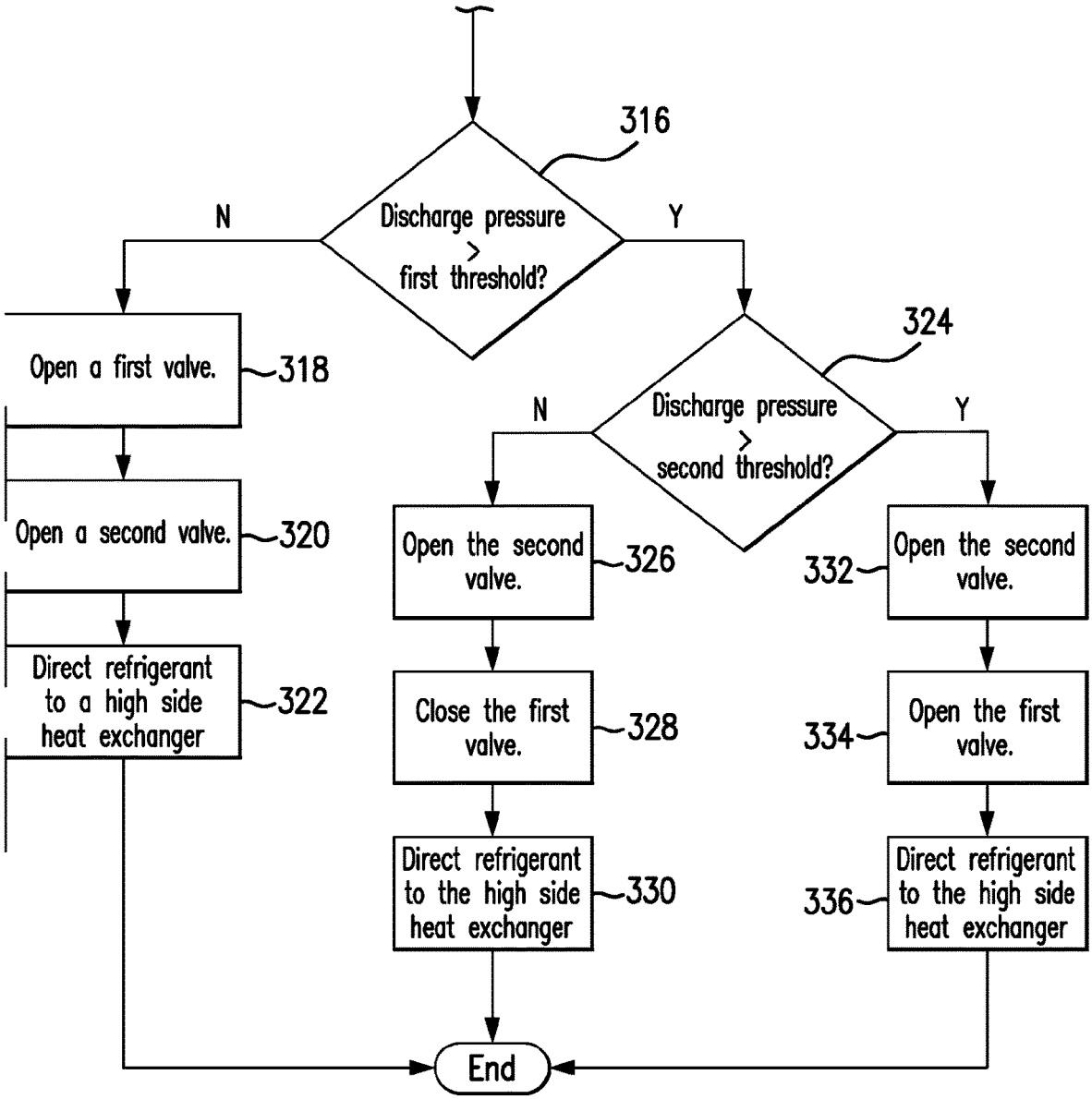

This disclosure contemplates an unconventional cooling system that uses P-traps to address the oil return issues that result from a vertical separation between the compressor and the high side heat exchanger. Generally, the vertical piping that carries the refrigerant from the compressor to the high side heat exchanger includes P-traps installed at various heights to capture oil in the refrigerant and to prevent that oil from flowing back to the compressor. As oil collects in the P-traps, the refrigerant begins to push the oil upwards until the oil reaches the high side heat exchanger. Multiple piping of different sizes may be used depending on a discharge pressure of the compressor. When the discharge pressure is higher, a larger piping may be used direct the oil and refrigerant to the high side heat exchanger. In this manner, the P-traps prevent oil from flowing back to the compressor when there is a vertical separation between the compressor and the high side heat exchanger. Additionally, the cooling system reduces energy consumption, size, and cost relative to a cooling system that uses a separate water cooling system to overcome the vertical separation between the compressor and the high side heat exchanger. The cooling system will be described using FIGS. 1A through 3. FIGS. 1A-1B will describe an existing cooling system. FIGS. 2A-2B and 3 describe the cooling system that uses P-traps.

FIG. 1A illustrates an example cooling system 100. As shown in FIG. 1A, system 100 includes a high side heat exchanger 102, a flash tank 104, a low temperature low side heat exchanger 106, a medium temperature low side heat exchanger 108, a low temperature compressor 110, a medium temperature compressor 112, a valve 114, and an oil separator 116. Generally, system 100 cycles a refrigerant to cool spaces proximate the low side heat exchangers 106 and 108. Cooling system 100 or any cooling system described herein may include any number of low side heat exchangers, whether low temperature or medium temperature.

High side heat exchanger 102 removes heat from a refrigerant. When heat is removed from the refrigerant, the refrigerant is cooled. High side heat exchanger 102 may be operated as a condenser and/or a gas cooler. When operating as a condenser, high side heat exchanger 102 cools the refrigerant such that the state of the refrigerant changes from a gas to a liquid. When operating as a gas cooler, high side heat exchanger 102 cools gaseous refrigerant and the refrigerant remains a gas. In certain configurations, high side heat exchanger 102 is positioned such that heat removed from the refrigerant may be discharged into the air. For example, high side heat exchanger 102 may be positioned on a rooftop so that heat removed from the refrigerant may be discharged into the air. This disclosure contemplates any suitable refrigerant (e.g., carbon dioxide) being used in any of the disclosed cooling systems.

Flash tank 104 stores refrigerant received from high side heat exchanger 102. This disclosure contemplates flash tank 104 storing refrigerant in any state such as, for example, a liquid state and/or a gaseous state. Refrigerant leaving flash tank 104 is fed to low temperature low side heat exchanger 106 and medium temperature low side heat exchanger 108. In some embodiments, a flash gas and/or a gaseous refrigerant is released from flash tank 104. By releasing flash gas, the pressure within flash tank 104 may be reduced.

System 100 includes a low temperature portion and a medium temperature portion. The low temperature portion operates at a lower temperature than the medium temperature portion. In some refrigeration systems, the low temperature portion may be a freezer system and the medium temperature system may be a regular refrigeration system. In a grocery store setting, the low temperature portion may include freezers used to hold frozen foods, and the medium temperature portion may include refrigerated shelves used to hold produce. Refrigerant flows from flash tank 104 to both the low temperature and medium temperature portions of the refrigeration system. For example, the refrigerant flows to low temperature low side heat exchanger 106 and medium temperature low side heat exchanger 108.

When the refrigerant reaches low temperature low side heat exchanger 106 or medium temperature low side heat exchanger 108, the refrigerant removes heat from the air around low temperature low side heat exchanger 106 or medium temperature low side heat exchanger 108. For example, the refrigerant cools metallic components (e.g., metallic coils, plates, and/or tubes) of low temperature low side heat exchanger 106 and medium temperature low side heat exchanger 108 as the refrigerant passes through low temperature low side heat exchanger 106 and medium temperature low side heat exchanger 108. These metallic components may then cool the air around them. The cooled air may then be circulated such as, for example, by a fan to cool a space such as, for example, a freezer and/or a refrigerated shelf. As refrigerant passes through low temperature low side heat exchanger 106 and medium temperature low side heat exchanger 108, the refrigerant may change from a liquid state to a gaseous state as it absorbs heat. Any number of low temperature low side heat exchangers 106 and medium temperature low side heat exchangers 108 may be included in any of the disclosed cooling systems.

Refrigerant flows from low temperature low side heat exchanger 106 and medium temperature low side heat exchanger 108 to compressors 110 and 112. The disclosed cooling systems may include any number of low temperature compressors 110 and medium temperature compressors 112. Both the low temperature compressor 110 and medium temperature compressor 112 compress refrigerant to increase the pressure of the refrigerant. As a result, the heat in the refrigerant may become concentrated and the refrigerant may become a high-pressure gas. Low temperature compressor 110 compresses refrigerant from low temperature low side heat exchanger 106 and sends the compressed refrigerant to medium temperature compressor 112. Medium temperature compressor 112 compresses a mixture of the refrigerant from low temperature compressor 110 and medium temperature low side heat exchanger 108. When the compressors 110 and 112 compress the refrigerant, oil that coats certain components of compressors 110 and 112 may mix with and be discharged with the refrigerant.

Valve 114 controls a flow of flash gas from flash tank 104. When valve 114 is closed, flash tank 104 may not discharge flash gas through valve 114. When valve 114 is opened, flash tank 104 may discharge flash gas through valve 114. In this manner, valve 114 may also control an internal pressure of flash tank 104. Valve 114 directs flash gas to medium temperature compressor 112. Medium temperature compressor 112 compresses the flash gas along with refrigerant from low temperature compressor 110 and medium temperature low side heat exchanger 108.

FIG. 1B illustrates example cooling system 100 installed in a tall building 120. As seen in FIG. 1B, high side heat exchanger 102 is positioned on the roof of the building 120. Rack 122, which includes the other components of system 100 such as compressors 110 and 112, is positioned on a lower level of building 120. Thus, a significant vertical separation exists between high side heat exchanger 102 and compressors 110 and 112. If refrigerant from compressors 110 and/or 112 were directed to high side heat exchanger 102, the oil that mixed with the refrigerant discharged by the compressors 110 and/or 112 may not be able to overcome the vertical separation and, as a result, the oil may flow backwards to the compressor 112. To avoid this oil return issue, a separate water cooling system 124 is installed so that the refrigerant need not be directed to high side heat exchanger 102. Water cooling system 124 cycles water that absorbs heat from the refrigerant discharged by compressor 112. The water is then pumped to high side heat exchanger 102 on the roof so that the absorbed heat can be removed. The water is then cycled back down from high side heat exchanger 102 to absorb more heat from the refrigerant. The cooled refrigerant is cycled back to the rest of the cooling system, bypassing the high side heat exchanger 102. Water cooling system 124, however, increases the overall energy consumption, size, and cost of the cooling system.

This disclosure contemplates an unconventional cooling system that uses P-traps to address the oil return issues that result from a vertical separation between the compressor 112 and the high side heat exchanger 102. Generally, the vertical piping that carries the refrigerant from the compressor 112 to the high side heat exchanger 102 includes P-traps installed at various heights to capture oil in the refrigerant and to prevent that oil from flowing back to the compressor 112. As oil collects in the P-traps, the refrigerant begins to push the oil upwards until the oil reaches the high side heat exchanger 102. Multiple piping of different sizes may be used depending on a discharge pressure of the compressor 112. When the discharge pressure is higher, a larger piping may be used direct the oil and refrigerant to the high side heat exchanger 102. In this manner, the P-traps prevent oil from flowing back to the compressor 112 when there is a vertical separation between the compressor 112 and the high side heat exchanger 102. Additionally, the cooling system reduces energy consumption, size, and cost relative to a cooling system that uses a separate water cooling system 124 to overcome the vertical separation between the compressor 112 and the high side heat exchanger 102. Embodiments of the cooling system are described below using FIGS. 2A-2B and 3. These figures illustrate embodiments that include a certain number of low side heat exchangers and compressors for clarity and readability. These embodiments may include any suitable number of low side heat exchangers and compressors.

FIGS. 2A-2B illustrate example cooling systems 200. Generally, cooling system 200 includes P-traps installed in the vertical piping used to direct refrigerant from compressor 112 to high side heat exchanger 102. The P-traps collect oil and prevent that oil from flowing back to compressor 112.

FIG. 2A illustrates an example cooling system 200A. As seen in FIG. 2A, system 200A includes a high side heat exchanger 102, a flash tank 104, a low temperature low side heat exchanger 106, a medium temperature low side heat exchanger 108, a low temperature compressor 110, a medium temperature compressor 112, valve 114, piping 202A and 202B, valves 206A and 206B, and sensor 208. There may be a significant vertical separation between high side heat exchanger 102 and medium temperature compressor 112. For example, high side heat exchanger 102 may be installed on the roof of a building such that high side heat exchanger 102 is over 50 feet higher than medium temperature compressor 112. To overcome the issues associated with directing refrigerant up this vertical separation (e.g., oil flowing back to compressor 112), system 200A uses piping 202 that includes P-traps to collect oil and to prevent that oil from flowing back to medium temperature compressor 112. As oil collects in the P-traps, the refrigerant may begin pushing the oil up piping 202 until the oil reaches high side heat exchanger 102. In this manner, the oil is prevented from flowing downwards back to compressor 112. As a result, system 200A does not need to use a separate water cooling system, which reduces energy consumption, size, and cost in certain embodiments.

Several components of system 200A operate similarly as they did in system 100. For example, high side heat exchanger 102 removes heat from a refrigerant. Flash tank 104 stores the refrigerant. Low temperature low side heat exchanger 106 and medium temperature low side heat exchanger 108 use refrigerant to cool spaces proximate low temperature low side heat exchanger 106 and medium temperature low side heat exchanger 108. Low temperature compressor 110 compresses refrigerant from low temperature low side heat exchanger 106. Medium temperature compressor 112 compresses refrigerant from low temperature compressor 110, medium temperature low side heat exchanger 108, and flash tank 104. Valve 114 controls the flow of refrigerant, as a flash gas, from flash tank 104 to medium temperature compressor 112.

Piping 202A and 202B direct refrigerant from medium temperature compressor 112 to high side heat exchanger 102. The structure of piping 202A and 202B allows piping 202A and 202B to carry refrigerant up the vertical separation to high side heat exchanger 102 without allowing oil to flow back to medium temperature compressor 112. Although system 200A is illustrated with only two piping 202A and 202B, system 200A (and any system described herein) may include any suitable number of piping (e.g., three, four, five, etc.).

As seen in FIG. 2A, piping 202A and 202B includes P-traps 204 installed at various heights on piping 202A and 202B. P-trap 204A is installed on piping 202A at a lower height than P-traps 204B and 204C. P-trap 204B is installed on piping 202A at a lower height than P-traps 204C. P-trap 204D is installed on piping 202B at a lower height than P-traps 204E and 204F. P-trap 204E is installed on piping 202B at a lower height than P-trap 204F. Each P-trap 204 may be positioned ten to twenty feet vertically above or below the next or preceding P-trap 204. In other words, there may be a P-trap 204 positioned every ten to twenty feet of piping 202. Each piping 202 described herein may include any suitable number of P-traps 204. The greater the vertical separation between high side heat exchanger 102 and compressor 112, the more P-traps 204 are positioned on piping 202.

Refrigerant flowing from medium temperature compressor 112 to high side heat exchanger 102 through one of piping 202A and 202B will flow through P-traps 204A-C or P-traps 204D-F enroute to high side heat exchanger 102. As the refrigerant, which is a vapor, flows through piping 202A or 202B, oil in the refrigerant may begin to flow back towards medium temperature compressor 112. P-traps 204A-F collect the oil before the oil reaches medium temperature compressor 112. As a result, P-traps 204A-F prevent oil from flowing back to medium temperature compressor 112. As more refrigerant is sent through piping 202A or 202B, more oil collects in P-traps 204A-F.

As more oil collects in P-traps 204A-F, the refrigerant flowing through piping 202A or 202B will begin pushing the oil in these P-traps 204A-F upwards until the oil reaches the next P-trap 204 and/or until the oil reaches high side heat exchanger 102. For example, as refrigerant flows through piping 202A, oil will begin collecting in P-trap 204A. As the level of oil in P-trap 204A increases, the refrigerant in piping 202A will begin pushing that oil upwards until that oil reaches and is collected by P-trap 204B. As the level of oil in P-trap 204B increases, the refrigerant in piping 202A will begin pushing that oil upwards. This process continues until that oil reaches and is collected by P-trap 204C. As the level of oil in P-trap 204C increases the refrigerant in piping 202A will begin pushing that oil upwards until that oil reaches high side heat exchanger 102. In this manner, oil is kept flowing in system 200A in the same direction as the refrigerant.

Valves 206A and 206B control a flow of refrigerant and/or oil through piping 202A and 202B, respectively. When valve 206A is open, valve 206A allows refrigerant and/or oil to flow through piping 202A. When valve 206A is closed, valve 206A prevents refrigerant and/or oil from flowing through piping 202A. Similarly, when valve 206B is open, valve 206B allows refrigerant and/or oil to flow through piping 202B. When valve 206B is closed, valve 206B prevents refrigerant and/or oil from flowing through piping 202B.

In certain embodiments, piping 202A and 202B may be different sizes. For example, piping 202A may be ⅞ of an inch in diameter and piping 202B may be 1 and ⅛ inches in diameter. The smaller size of piping 202A may result in refrigerant and/or oil flowing through piping 202A to maintain a higher velocity and experience a smaller pressure drop than refrigerant and/or oil flowing through piping 202B. Valves 206A and 206B can be controlled to send refrigerant and/or oil from compressor 112 through differently sized piping 202A and 202B depending on the discharge pressure and/or capacity of compressor 112. For example, sensor 208 may be a pressure sensor that detects a discharge pressure and/or capacity of compressor 112. When the discharge pressure and/or capacity is below a first threshold (e.g., 40%), valve 206A may be opened and valve 206B may be closed such that refrigerant and/or oil from compressor 112 is directed through the smaller piping 202A. In this manner, the smaller piping 202A is used to maintain sufficient velocity and pressure to push oil up piping 202A when the discharge pressure and/or capacity of compressor 112 is low. When the discharge pressure and/or capacity of compressor 112 is between the first threshold (e.g., 40%) and a second threshold (e.g., 70%) that is higher than the first threshold, valve 206A may be closed and valve 206B may be open such that refrigerant and/or oil from compressor 112 is directed through larger piping 202B. In this manner, the larger piping 202B is used when the discharge pressure and/or capacity of compressor 112 are high enough such that the refrigerant discharged from compressor 112 can push oil up piping 202B. When the discharge pressure and/or capacity of compressor 112 is above the second threshold (e.g., 70%), both valves 206A and 206B may be open such that refrigerant and/or oil from compressor 112 is directed through both piping 202A and 202B. In this manner, both piping 202A and 202B are used when the discharge pressure and/or capacity of compressor 112 necessitates additional piping 202 to handle the refrigerant discharge of compressor 112.

FIG. 2B illustrates an example cooling system 200B. Generally, in system 200B, piping 202A and 202B are the same size and valve 206A is removed such that refrigerant and/or oil from compressor 112 is always directed through at least piping 202A.

Several components of system 200B operate similarly as they did in system 200A. High side heat exchanger 102 removes heat from a refrigerant. Flash tank 104 stores the refrigerant. Low temperature low side heat exchangers 106 and medium temperature low side heat exchanger 108 use refrigerant to cool spaces proximate low temperature low side heat exchanger 106 and medium temperature low side heat exchanger 108. Low temperature compressor 110 compresses refrigerant from low temperature low side heat exchanger 106. Medium temperature compressor 112 compresses refrigerant from low temperature compressor 110, medium temperature low side heat exchanger 108, and flash tank 104. Valve 114 controls the flow of refrigerant, as a flash gas, from flash tank 104 to medium temperature compressor 112. Piping 202A and 202B direct refrigerant from medium temperature compressor 112 to high side heat exchanger 102. P-traps 204A-F collect oil and prevent that oil from flowing back to medium temperature compressor 112. Valve 206B controls a flow of oil and/or refrigerant through piping 202B. Sensor 208 is a pressure sensor that detects a discharge pressure of medium temperature compressor 112.

As discussed above, in system 200B, piping 202A and 202B are the same size. Additionally, valve 206A is removed such that refrigerant and/or oil from compressor 112 is always directed at least through piping 202A. Similar to system 200A, valve 206B may open or closed depending on a discharge pressure and/or capacity of compressor 112 detected by sensor 208. For example, when the discharge pressure and/or capacity falls below a threshold (e.g., 60%), valve 206B is closed such that refrigerant and/or oil from compressor 112 is directed through piping 202A but not piping 202B. In this manner, only one piping 202A is used when the discharge pressure and/or capacity of compressor 112 is lower. When the discharge pressure and/or capacity exceeds the threshold (e.g., 60%), valve 206B is opened such that refrigerant and/or oil from compressor 112 is directed through both piping 202A and piping 202B. In this manner, the amount of available piping 202 effectively doubles when the discharge pressure and/or capacity of compressor 112 is higher.

FIG. 3 is a flow chart illustrating a method 300 of operating an example cooling system 200. Generally, various components of systems 200A and 200B perform the steps of method 300. In particular embodiments, performing method 300 reduces the energy consumption, size, and cost of cooling systems 200A and 200B relative to cooling systems that use a water cooling system.

In step 302, high side heat exchanger 102 removes heat from a refrigerant. Flash tank 104 stores the refrigerant in step 304. In step 306, low temperature low side heat exchanger 106 uses the refrigerant to cool a space. In step 308, medium temperature low side heat exchanger 108 uses the refrigerant to cool a space. Low temperature compressor 110 compresses the refrigerant from low temperature low side heat exchanger 106 in step 310. In step 312, medium temperature compressor 112 compresses the refrigerant from low temperature compressor 110, medium temperature low side heat exchanger 108, and flash tank 104. In step 314, sensor 208 detects a discharge pressure of medium temperature compressor 112.

In step 316, it is determined whether the detected discharge pressure exceeds a first threshold. If the discharge pressure does not exceed the first threshold, then a first valve 206A opens in step 318, a second valve 206B closes in step 320, and piping 202A directs refrigerant to high side heat exchanger 102 in step 322. If the discharge pressure does exceed the first threshold, then it is determined in step 324 whether the discharge pressure exceeds a second threshold that is higher than the first threshold. If the discharge pressure does not exceed the second threshold, then the second valve 206B opens in step 326, the first valve 206A closes in step 328, and piping 202B directs refrigerant to high side heat exchanger 102 in step 330. If the discharge pressure exceeds the second threshold, then the second valve 206B is opened in step 332, the first valve 206A is opened in step 334, and piping 202A and 202B direct refrigerant to the high side heat exchanger 102 in step 336.

Modifications, additions, or omissions may be made to method 300 depicted in FIG. 3. Method 300 may include more, fewer, or other steps. For example, steps may be performed in parallel or in any suitable order. While discussed as systems 200A and 200B (or components thereof) performing the steps, any suitable component of systems 200A and 200B may perform one or more steps of the method.

Modifications, additions, or omissions may be made to the systems and apparatuses described herein without departing from the scope of the disclosure. The components of the systems and apparatuses may be integrated or separated. Moreover, the operations of the systems and apparatuses may be performed by more, fewer, or other components. Additionally, operations of the systems and apparatuses may be performed using any suitable logic comprising software, hardware, and/or other logic. As used in this document, "each" refers to each member of a set or each member of a subset of a set.

This disclosure may refer to a refrigerant being from a particular component of a system (e.g., the refrigerant from the medium temperature compressor, the refrigerant from the low temperature compressor, the refrigerant from the flash tank, etc.). When such terminology is used, this disclosure is not limiting the described refrigerant to being directly from the particular component. This disclosure contemplates refrigerant being from a particular component (e.g., the low temperature low side heat exchanger) even though there may be other intervening components between the particular component and the destination of the refrigerant. For example, the medium temperature compressor receives a refrigerant from the low temperature low side heat exchanger even though there is a low temperature compressor between the low temperature low side heat exchanger and the medium temperature compressor.

Although the present disclosure includes several embodiments, a myriad of changes, variations, alterations, transformations, and modifications may be suggested to one skilled in the art, and it is intended that the present disclosure encompass such changes, variations, alterations, transformations, and modifications as fall within the scope of the appended claims.

What is claimed is:

1. A system comprising:

a high side heat exchanger configured to remove heat from a refrigerant;

a first low side heat exchanger configured to use the refrigerant to cool a first space;

a second low side heat exchanger configured to use the refrigerant to cool a second space;

a first compressor configured to compress refrigerant from the first low side heat exchanger;

a second compressor configured to compress refrigerant from the second low side heat exchanger and the first compressor, the high side heat exchanger positioned vertically above the second compressor;

first piping configured to direct refrigerant from the second compressor to the high side heat exchanger, the first piping comprising:

a first p-trap positioned vertically above the second compressor and vertically below the high side heat exchanger; and a second p-trap positioned vertically above the first p-trap and vertically below the high side heat exchanger;

second piping configured to direct refrigerant from the second compressor to the high side heat exchanger, the second piping is larger than the first piping, the second piping comprising:

a third p-trap positioned vertically above the second compressor and vertically below the high side heat exchanger; and a fourth p-trap positioned vertically above the first p-trap and vertically below the high side heat exchanger.

2. The system of claim 1, further comprising: a first valve configured to control a flow a refrigerant from the second compressor to the first piping; a second valve configured to control a flow of refrigerant from the second compressor to the second piping; and a sensor configured to detect a discharge pressure of the second compressor, wherein the first valve opens and the second valve closes when the discharge pressure falls below a first threshold.

3. The system of claim 2, wherein the first valve closes and the second valve opens when the discharge pressure is between the first threshold and a second threshold greater than the first threshold.

4. The system of claim 3, wherein the first and second valves open when the discharge pressure is above the second threshold.

5. The system of claim 1, wherein the second p-trap is positioned between ten and twenty feet above the first p-trap, and the fourth p-trap is positioned between ten and twenty feet above the third p-trap.

6. The system of claim 1, wherein the high side heat exchanger is positioned at least fifty feet vertically above the second compressor.

7. The system of claim 1, wherein the first piping further comprises a fifth p-trap positioned vertically above the second p-trap and vertically below the high side heat exchanger.

8. A method comprising:

removing, by a high side heat exchanger, heat from a refrigerant;

using, by a first low side heat exchanger, the refrigerant to cool a first space;

using, by a second low side heat exchanger, the refrigerant to cool a second space;

compressing, by a first compressor, refrigerant from the first low side heat exchanger;

compressing, by a second compressor, refrigerant from the second low side heat exchanger and the first compressor, the high side heat exchanger positioned vertically above the second compressor;

directing, by first piping, refrigerant from the second compressor to the high side heat exchanger, the first piping comprising:

a first p-trap positioned vertically above the second compressor and vertically below the high side heat exchanger; and a second p-trap positioned vertically above the first p-trap and vertically below the high side heat exchanger;

directing, by second piping, refrigerant from the second compressor to the high side heat exchanger, the second piping is larger than the first piping, the second piping comprising:

a third p-trap positioned vertically above the second compressor and vertically below the high side heat exchanger; and a fourth p-trap positioned vertically above the first p-trap and vertically below the high side heat exchanger.

9. The method of claim 8, further comprising:

controlling, by a first valve, a flow of refrigerant from the second compressor to the first piping;

controlling, by a second valve, a flow of refrigerant from the second compressor to the second piping;

detecting, by a sensor, a discharge pressure of the second compressor;

opening the first valve when the discharge pressure falls below a first threshold; and closing the second valve when the discharge pressure falls below the first threshold.

10. The method of claim 9, further comprising:

closing the first valve when the discharge pressure is between the first threshold and a second threshold greater than the first threshold; and opening the second valve when the discharge pressure is between the first threshold and the second threshold.

11. The method of claim 10, further comprising opening the first and second valves when the discharge pressure is above the second threshold.

12. The method of claim 8, wherein the second p-trap is positioned between ten and twenty feet above the first p-trap, and the fourth p-trap is positioned between ten and twenty feet above the third p-trap.

13. The method of claim 8, wherein the high side heat exchanger is positioned at least fifty feet vertically above the second compressor.

14. The method of claim 8, wherein the first piping further comprises a fifth p-trap positioned vertically above the second p-trap and vertically below the high side heat exchanger.

15. A system comprising:

a high side heat exchanger configured to remove heat from a refrigerant;

a first low side heat exchanger configured to use the refrigerant to cool a first space;

a second low side heat exchanger configured to use the refrigerant to cool a second space;

a first compressor configured to compress refrigerant from the first low side heat exchanger;

a second compressor configured to compress refrigerant from the second low side heat exchanger and the first compressor, the high side heat exchanger positioned vertically above the second compressor;

first piping configured to direct refrigerant from the second compressor to the high side heat exchanger, the first piping comprising:

a first p-trap positioned vertically above the second compressor and vertically below the high side heat exchanger; and a second p-trap positioned vertically above the first p-trap and vertically below the high side heat exchanger;

second piping configured to direct refrigerant from the second compressor to the high side heat exchanger, the second piping is the same size as the first piping, the second piping comprising:

a third p-trap positioned vertically above the second compressor and vertically below the high side heat exchanger; and a fourth p-trap positioned vertically above the first p-trap and vertically below the high side heat exchanger.

16. The system of claim 15, further comprising a valve configured to control a flow of refrigerant from the second compressor to the second piping, and a sensor configured to detect a discharge pressure of the second compressor, wherein the valve closes when the discharge pressure falls below a threshold.

17. The system of claim 16, wherein the valve opens when the discharge pressure is above the threshold.

18. The system of claim 15, wherein the second p-trap is positioned between ten and twenty feet above the first p-trap, and the fourth p-trap is positioned between ten and twenty feet above the third p-trap.

19. The system of claim 15, wherein the high side heat exchanger is positioned at least fifty feet vertically above the second compressor.

20. The system of claim 15, wherein the first piping further comprises a fifth p-trap positioned vertically above the second p-trap and vertically below the high side heat exchanger.

* * * * *